US005915580A

United States Patent [19]

Melk

[11] Patent Number: 5,915,580

[45] Date of Patent: Jun. 29, 1999

[54] CONTAINER COVERING

[75] Inventor: Thomas J. Melk, Chicago, Ill.

[73] Assignee: Outer Circle Products, Ltd., Chicago, Ill.

[21] Appl. No.: 08/997,788

[22] Filed: Dec. 24, 1997

[51] Int. Cl.[6] ..... B65D 23/12

[52] U.S. Cl. ..... 215/386; 215/395; 220/903; 220/592.24; 220/626; 220/739; 224/148.5

[58] Field of Search ..... 215/386, 395; 220/903, 592.24, 626, 739; 224/148.5, 148.4, 448.3; 229/89, 91; 150/154

[56] References Cited

U.S. PATENT DOCUMENTS

| | | | |
|---|---|---|---|
| D. 247,392 | 2/1978 | Coleman | D3/289 |
| D. 315,848 | 4/1991 | Guzman | D7/608 |
| D. 357,845 | 5/1995 | Herszenberg | D3/229 X |
| D. 373,677 | 9/1996 | Kelly | D3/229 |
| 1,254,640 | 1/1918 | Stevenson | 206/315.8 |
| 1,438,263 | 12/1922 | Rothschild | 206/315.8 |
| 1,498,910 | 6/1924 | Harpham | 206/315.8 |
| 1,556,286 | 10/1925 | Keeler | 206/315.8 |
| 2,376,194 | 5/1945 | Samuels | D3/202 X |
| 2,389,390 | 11/1945 | Silverman et al. | 215/12.1 X |
| 2,458,737 | 1/1949 | Salkowitz | 215/12.1 |
| 2,482,322 | 9/1949 | Cortese | 215/12.1 |
| 3,869,966 | 3/1975 | Brandigi et al. | 215/12.1 X |
| 4,197,890 | 4/1980 | Simko | D3/229 X |
| 4,513,895 | 4/1985 | Leslie | D3/202 X |
| 4,802,602 | 2/1989 | Evans et al. | 224/148.3 X |
| 4,871,597 | 10/1989 | Hobson | D3/202 X |
| 5,415,305 | 5/1995 | Drake-Tipton et al. | 220/903 X |
| 5,553,733 | 9/1996 | Rosenthal | 220/626 X |

*Primary Examiner*—Gary E. Elkins
*Assistant Examiner*—Tri M. Mai
*Attorney, Agent, or Firm*—Trexler, Bushnell, Giangiorgi & Blackstone, Ltd.

[57] ABSTRACT

Disclosed is a container covering. The covering has an opening for receiving the container, and includes a body, a base and a support member attached to the base and the body. The support member promotes maintaining the covering in an upright position when the covering is so positioned.

10 Claims, 3 Drawing Sheets

CONTAINER COVERING

BACKGROUND

The present invention relates generally to container coverings, and relates more specifically to a novel container covering which includes a support member which assists to maintain the covering in an upright position.

Coverings for containers are useful and have become widely used. Many container coverings have straps or other structure for attaching the container to a structure. For example, some container coverings are adapted to secure to a bicycle frame. Therefore, some people use these coverings while cycling so that their hands remain free to operate the bicycle. Moreover, some coverings are adapted to secure to a belt. Therefore, some people use these coverings to retain a container while jogging.

While some coverings are hard, it is preferable to provide a covering which is pliable. Pliable coverings are generally more readily able to conform to a specific container and generally weigh less than more rigid container coverings.

In addition to being pliable, it is often desirable to provide that a covering is insulating. As a result, one may use the container covering to keep a cool drink readily available for consumption while cycling, jogging, etc. In other instances, it may be desirable to keep a hot drink readily available for consumption (e.g., coffee), and using an insulating container covering makes this possible.

While a variety of pliable, insulating coverings are presently commercially available, the pliability of these coverings usually renders the coverings unstable in the upright position. The instability is heightened when a pliable covering has not received a container because it is the container which usually renders rigidity, shape and stability to a pliable covering. Absent the container, a pliable covering usually is difficult to maintain in an upright position. As a result, it is often difficult, for example, to achieve and maintain an orderly, upright arrangement of pliable coverings on a retail shelf.

Furthermore, even after a pliable covering receives a container, the pliable covering and container may be rendered unstable in the upright position, or an upright position of the two may be unattainable. For example, because a bottom of a pliable covering usually generally conforms to a bottom of the container, the shape of the bottom of the container dictates the amount of stability the two will have in an upright position. In other words, most pliable coverings are unstable in, or cannot achieve, an upright position without receiving a container, and after receiving a container, the stability of the two is dictated by the shape of the bottom of the container. Therefore, should the bottom of the container become warped, dented, etc., the typical pliable covering cannot render stability and assistance to the container to maintain the container in an upright position.

The present invention is directed to solve the problems discussed hereinabove.

OBJECTS AND SUMMARY

A general object of the present invention is to provide a container covering which is stable when arranged in an upright position.

Another object of the present invention is to provide a container covering which includes a support member that promotes maintaining the container covering in an upright position.

Still another object of the present invention is to provide a container covering that includes a support member which promotes maintaining the container covering in an upright position regardless of whether the covering has received a container.

Still a further object of the present invention is to provide container covering which includes a support member which promotes maintaining the container covering in an upright position regardless of whether the covering has received a container, thereby providing that the container covering can be maintained within an orderly, upright arrangement in a retail sales setting.

Briefly, and in accordance with the above, the present invention envisions a covering having an opening for receiving a container. The covering includes a body, a base and a support member attached to the base and the body. The support member assists to maintain the covering in an upright position when the covering is so positioned.

An illustrated embodiment of the present invention is a container covering having an opening for receiving a container. The container covering includes a body, a base and a support member attached to the base and the body where the support member is a generally rigid strip and the base and body are formed of a plurality of layers of material. A tape member overlies the support member and a portion of the body. When the covering is placed on a surface in an upright position, a portion of the external surface of the tape member contacts the surface and the base is suspended. At such time, the support member assists to maintain the covering in the upright position regardless of whether the covering has received a container.

BRIEF DESCRIPTION OF THE DRAWINGS

The organization and manner of the structure and function of the invention, together with further objects and advantages thereof, may be understood by reference to the following description taken in connection with the accompanying drawings, wherein like reference numerals identify like elements, and in which.

DESCRIPTION

Figure 6:
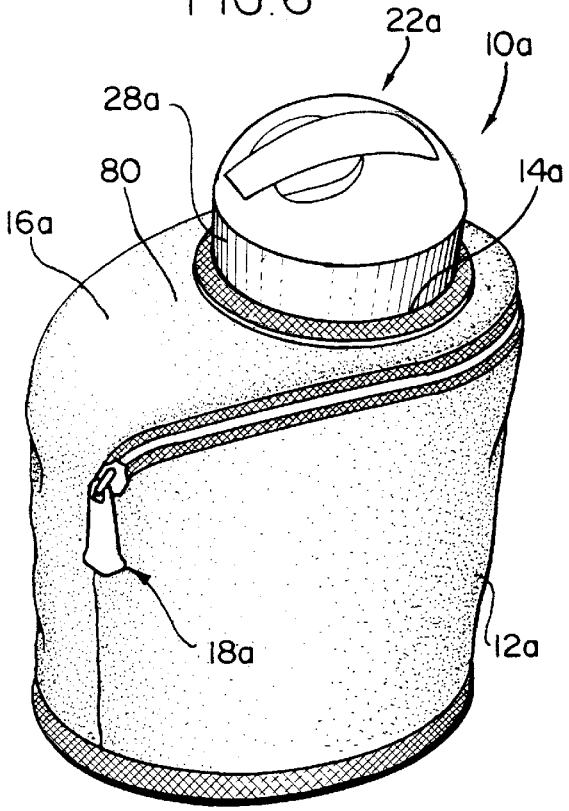
FIG. 6 is a perspective view of a second embodiment of a container covering in accordance with the present invention.
Figure 7:
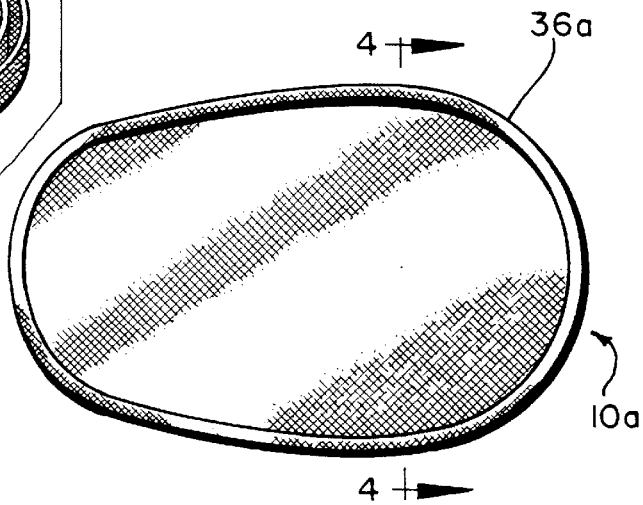
FIG. 7 is a bottom plan view of the container covering of FIG. 6.

Shown in the drawings are two embodiments of the present invention. More specifically, FIGS. 1–3 and 5 illustrate a container covering 10 in accordance with the present invention, and FIGS. 6 and 7 illustrate a second embodiment of a container covering 10*a* employing the present invention. FIG. 4 is applicable to both container coverings 10 or 10*a*.

Figure 1:
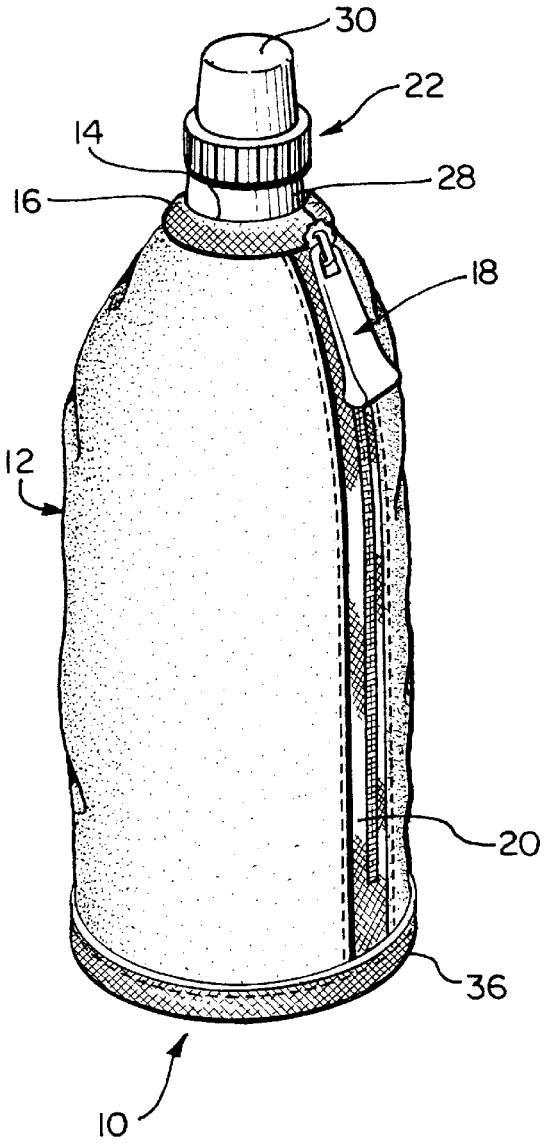
FIG. 1 is a perspective view of a container covering in accordance with the present invention.
Figure 2:
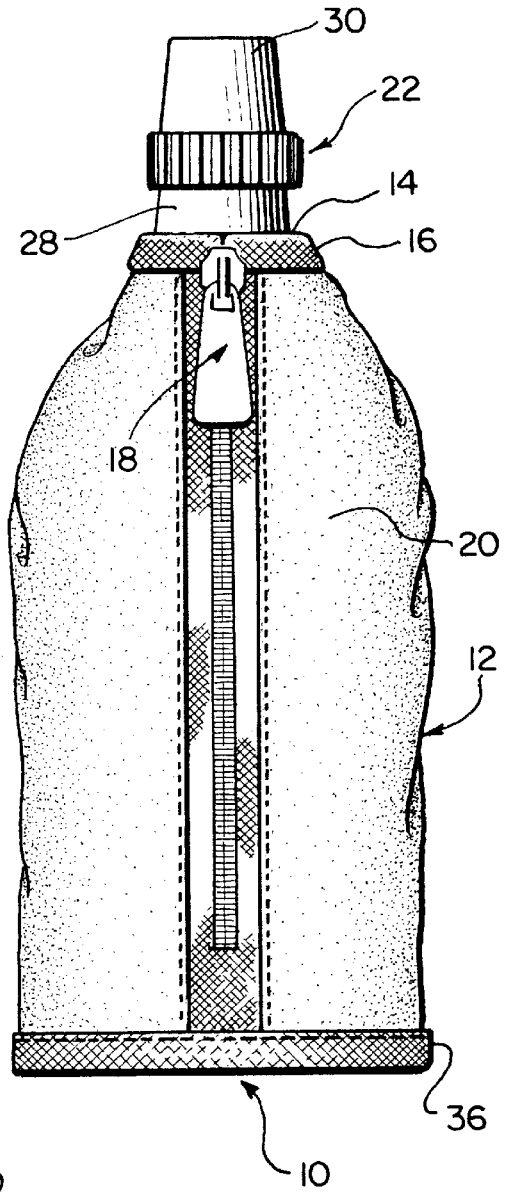
FIG. 2 is a front elevational view of the container covering of FIG. 1.

As shown in FIGS. 1 and 2, the container covering 10 includes a body 12 which has a generally continuous sleeve construction. The body 12 may include straps or handles thereon (not shown) for facilitating handling and transport of the container covering. The body 12 has an opening 14 at a top 16. The opening 14 is expandable by unzipping a zipper 18 from the top 16 of the body 12 down a side 20 thereof. When the zipper 18 is unzipped, a container 22, such as a one-liter container, can be placed in the container covering 10. After the container 22 is placed therein, the zipper 18 can be zipped closed such that the body 12 of the container covering 10 covers the body 26 of the container 22 (shown generally in FIG. 4). After the zipper 18 is zipped closed, the top 16 of the body 12 surrounds a neck 28 of the container 22 allowing a dispensing top 30 of the container 22 to extend through the top 16 of the container covering 10. Preferably, the body 12 is pliable and the container 22 is shaped such that the body 12 generally conforms to the body 26 of the container 22 when the container 22 is inserted therein and the zipper 18 zipped closed.

While a one-liter container generally coinciding with the shape of the container covering 10 when the zipper 18 is zipped closed is illustrated, other sizes and shapes of containers may be used in connection with the container covering 10. Moreover, the body 12 and/or opening 14 may be shaped differently than is depicted in FIGS. 1 and 2 in order to accommodate a container having a different size and shape. Additionally, the zipper 18 may be replaced by another form of closure device. For example, the top 16 of the container covering 10 may include a drawstring (not shown). In this case, a container 22 would be inserted downwardly into the container covering 10 through the top 16 thereof, and the drawstring would be pulled to tighten the top 16 of the around the neck 28 of the container 22.

Figure 3:
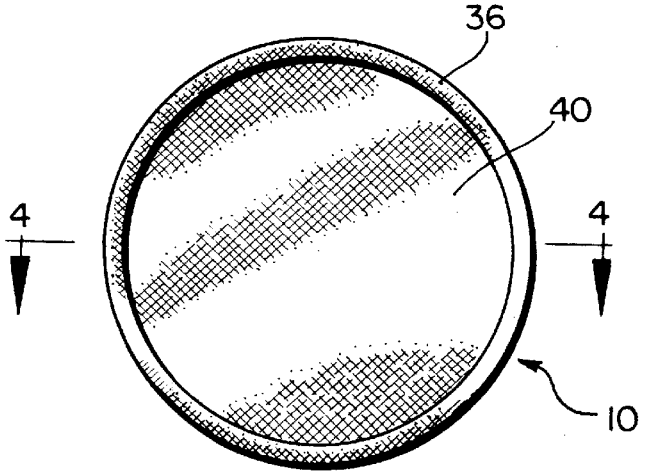
FIG. 3 is a bottom plan view of the container covering of FIG. 1.
Figure 4:
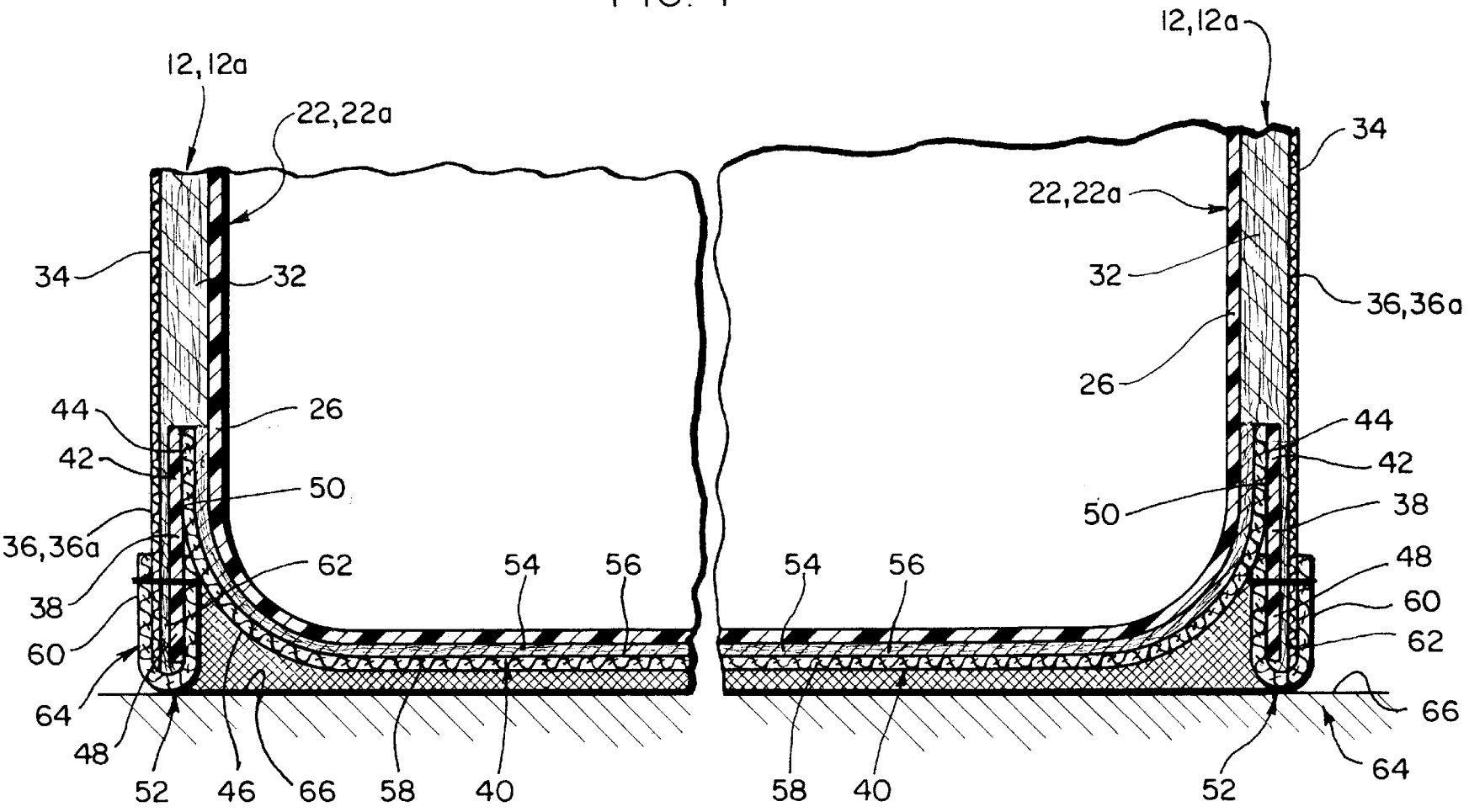
FIG. 4 is an enlarged, partial fragmentary, cross-sectional, side elevafional view, taken along line 4—4 of either FIG. 3 or FIG. 7, of a bottom portion of the container covering shown in either FIG. 1 or FIG. 6, respectively.

FIG. 3 is a view of the bottom 36 of the container covering 10, and FIG. 4 is a cross-sectional view of the bottom of the container covering 10, taken along line 4—4 of FIG. 3. As shown in FIG. 4, the body 12 of the container covering 10 is formed of a plurality of layers such as an internal layer 32 and an external layer 34. Preferably, the plurality of layers provide that the container 22 is insulated by the body 12 of the container covering 10 after the container 22 has been inserted therein. To this end, the internal layer 32 may comprise a fibrous material, and the external layer 34 may comprise a nylon material. However, the body 12 may instead be generally non-insulating. For example, the body 12 may be comprised of a mesh material.

Figure 5:
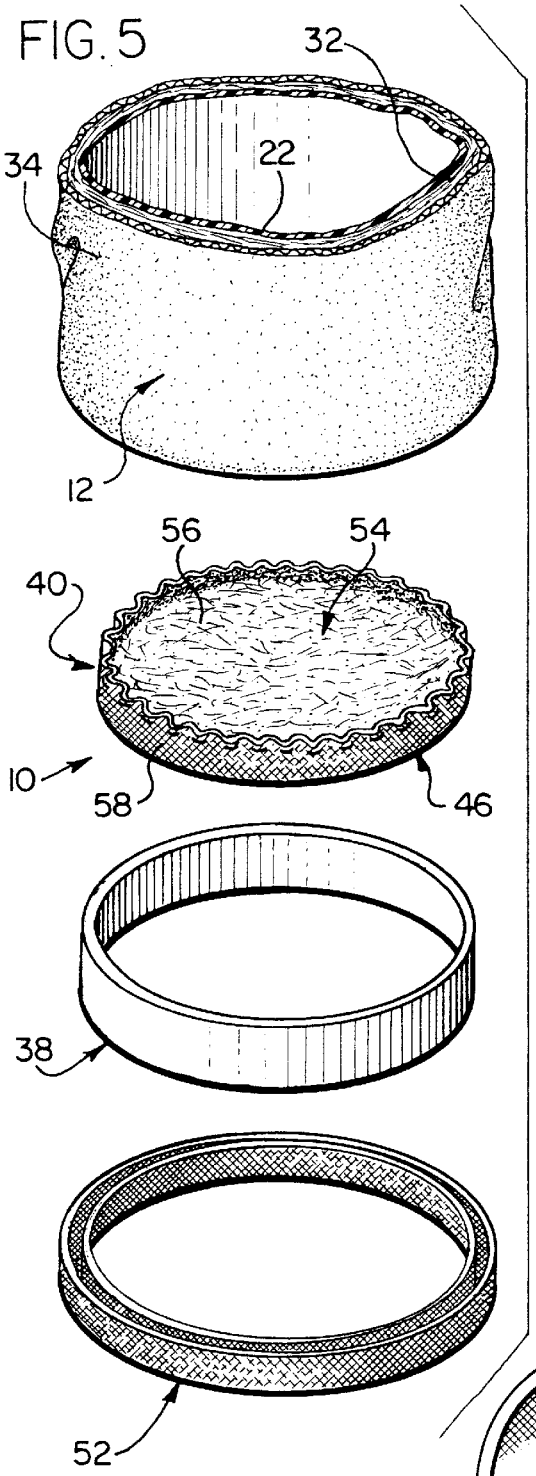
FIG. 5 is a partial fragmentary, exploded perspective view of the container covering of FIG. 1 showing the components thereof.

As shown in FIG. 4, at the bottom 36 of the container covering 10 is a support member 38 which is illustrated in FIGS. 4 and 5. The support member 38 supports and stabilizes the container covering 10 when the container covering 10 is placed in an upright position. To this end, the support member 38 may be a generally rigid strip such as a plastic strip. The support member 38 is positioned between the body 12 of the container covering 10 and a base 40 thereof. More specifically, an upper portion 42 of the support member 38 is attached, such as stitched, to an edge portion 44 of an external side 46 of the base 40, and a lower portion 48 of the support member 38 is attached, such as stitched, to a lower portion 50 of the internal surface 32 of the body 12 and to a tape member 52. As shown in FIG. 5, the base 40 is circular having an external side 46 and an opposing, internal side 54 which contacts the container 22 when the container 22 is inserted in the container covering 10 (shown in FIG. 4).

Like the body 12, preferably the base 40 is comprised of a plurality of layers of material, such as an internal layer 56 and an external layer 58 and the layers help to insulate the container 22 when the container 22 is inserted in the container covering 10. To this end, the internal layer 56 may comprise a fibrous material, and the external layer 58 may comprise a nylon material. However, like the body 12, the base 40 may also be generally non-insulating. For example, the base 40 may be comprised of a mesh material.

The tape member 52 may be a generally pliable fabric strip having an external surface 60 and an opposing, internal surface 62. As shown, the internal surface 62 of the tape member 52 contacts and is attached to, such as stitched to, the lower portion 50 of the body 12 and to the lower portion 48 of the support member 38 in a "U" shape thereby overlying and sandwiching the lower portion 50 of the body 12 and the lower portion 48 of the support member 38.

The support member 38 may be attached to the body 12 and to the base 40 in any suitable manner such as by stitching, gluing, welding, bonding, etc. However, preferably the upper portion 42 of the support member 38 is stitched to the base 40, and then be member 52 is stitched to the lower portion 50 of the body 12 and to the lower portion 48 of the support member 38.

The cover tape 52 and sandwiched lower portion 50 of the body 12 and lower portion 48 of the support member 38 form a support structure 64 which assists to maintain the container covering 10 in an upright position after the container covering 10 is so positioned as shown in FIG. 4. Specifically, the support member 38 provides substantially rigid support to the body 12 of the container covering 10 in a direction substantially parallel to a longitudinal axis of the body 12. The support which the support member 38 provides promotes substantially maintaining the body 12 in an upright position after the container covering 10 is so positioned regardless of whether a container 22 has been inserted therein.

Preferably, the shape and size of the base 40 is such that the base 40 is suspended off a surface 66 when the container covering 10 is placed thereon. As shown in FIG. 4, the support structure 64 contacts the surface 66, and specifically a portion of the external surface 60 of the tape member 52 contacts the surface 66. Preferably, the stability of the support structure 64, and specifically the rigidity of the support member 38, maintains the base 40 suspended from the surface 66, and the base 40 remains suspended even when a container 22 is inserted in the container covering 10. As a result, the container covering 10 can remain substantially upright even though the bottom of the container 22 may be deformed, dented, etc. While the base 40 of the container covering 10 will somewhat conform to the shape of the bottom of the container 22 because of the pliability of the base 40, the support structure 64 suspends the base 40 from the surface 66 on which the container covering 10 is placed. Therefore, the support member 38, and the support structure 64 as a whole, stabilizes the container covering 10 and assists to maintain the container covering 10 substantially in an upright position. The support member 38, and the support structure 64 as a whole, contacts a surface 66 on which the container covering 10 is placed, and assists in maintaining the container covering 10 in a substantially upright position even when a container 22 is not inserted in the container covering 10. As such, the container covering 10, and a plurality thereof, can be placed in an orderly, upright arrangement on a shelf, such as in a retail sales setting.

A second embodiment of the container covering 10*a* shown in FIG. 6 and employing the present invention is very much like container covering 10. In fact, FIG. 4 is applicable to either embodiment. Because of the similarity between the configuration, only the differences therebetween will be discussed with the understanding that one may review the discussion of container covering 10 to obtain an understanding of corresponding parts of container covering 10*a*.

Additionally, like parts will be identified with like reference numerals with the prefix "a" added.

As shown in FIG. 6, the container covering 10*a* also includes a body 2*a*, and a zipper 18*a*. However, the top 6*a* of the container covering 10*a* includes a hood 80 and the zipper 18*a*zips around the perimeter of the hood 80. An opening 14*a* is formed in the hood 80, and when the zipper 18*a* is unzipped, and the hood 80 flipped back (not shown), a container 2*a* somewhat larger than the container 22 insertable in the container covering 10 can be placed in the container covering 10*a*. For example, the container 2*a* may be a one-and-a-half liter container.

After the container 2*a* is placed therein, the hood 80 may be flipped down so that the opening 14*a* therein receives a neck 8*a* of the container 2*a*. Subsequently, the zipper 18*a* can be zipped closed so that the container 2*a* is retained within the container covering 10*a*.

The shape of the second embodiment container covering 10*a* is generally more oblong than the first embodiment container covering 10. FIG. 7 is a view of the bottom of the container covering 10*a* and depicts the overall oblong shape of the container covering 10*a*. A sectional view of the bottom of the container covering 10*a* shown in FIG. 7, taken along line 4—4, is identical to the sectional view of the bottom of the container covering 10 shown in FIG. 3, taken along line 4—4. FIG. 4, which has already been described with regard to container covering 10 illustrates this sectional view, and therefore is also applicable to container covering 10*a*. Therefore, description of the sectional view of the bottom of the container covering 10*a* is omitted with the understanding that one may review the above description of the structure appearing in FIG. 4 to obtain an understanding thereof.

The present invention provides that a container covering remains stable in an upright position after being so positioned. Additionally, the present invention provides that a container covering does not rely on the stability of a bottom of a container placed therein to be able to remain substantially upright. Still further, the present invention provides that a container covering can remain substantially upright even when a container has not been inserted therein. As a result, a plurality of container coverings each in accordance with the present invention can container covering falling over.

What is claimed is:

1. A covering having an opening for receiving a container in a cavity, said covering comprising a generally pliable body having an internal surface at least partially defining said cavity, an external surface, an upper portion and a lower portion; a generally pliable base having a first side positioned proximate said container when said container is received in said opening, and having an opposing, second side; an annular support member attached to said lower portion of said internal surface of said body and said second side of said base, said annular support member assisting to maintain the covering in an upright position after said covering is so positioned, said annular support member being positioned between a portion of the second side of said base and a portion of said body, said annular support member positioned relative to said body and said base such that at least a substantial portion of said annular support member is generally isolated from the cavity and is generally not exposed; and a tape member overlying said support member and said body, said tape member having an external surface and an opposing, internal surface, said internal surface contacting said support member and said body, said tape member sandwiching a lower portion of said body and a portion of said support member therebetween.

2. The covering as recited in claim 1, said support member comprising a generally rigid strip attached to said second side of said base and to said body.

3. The covering as recited in claim 1, a portion of the external surface of the member contacting a surface when said covering is placed thereon.

4. The covering as recited in claim 1, said base being suspended by said support member off a surface when said covering is placed thereon in an upright position.

5. The covering as recited in claim 1, each of said body and said base comprising plurality of layer of material.

6. A covering having an opening for receiving a container in a cavity, said covering comprising a generally pliable body having an internal surface at least partially defining said cavity, the internal surface of said body having an upper portion and a lower portion, a portion of the internal surface of said body positioned proximate said cavity; a generally pliable base having a first side positioned proximate said cavity, and having an opposing, second side; an annular support member attached to the lower portion of the internal surface of said body and the second side of said base member, said annular support member providing substantially rigid support to said body in a direction substantially parallel to a longitudinal axis of said body thereby promoting maintenance of said body in an upright position after said body is so positioned, said annular support member being positioned between a portion of the second side of said base and a portion of said body, said annular support member positioned relative to said body and said base such that at least a substantial portion of said annular support member is generally isolated from the cavity and is generally not exposed; tape member overlying said support member and said body, said tape member having an external surface and an opposing, internal surface, said internal surface contacting said support member and said body, said tape member sandwiching a lower portion of said body and a portion of said support member therebetween.

7. The covering as recited in claim 6, said support member comprising a generally rigid strip attached to said second side of said base and to said body.

8. The covering as recited in claim 6, portion of the external surface of the tape member contacting a surface when said covering is placed thereon.

9. The covering as recited in claim 6, said base being suspended by said support member off a surface when said covering is placed thereon in an upright position.

10. The covering as recited in claim 6, each of said body and said base comprising a plurality of layers of material.

* * * * *